United States Patent [19]

Nishioka

[11] 4,365,231

[45] Dec. 21, 1982

[54] VARIABLE RESISTOR DEVICE WITH LOCK MECHANISM

[75] Inventor: Matsuo Nishioka, Hirakata, Japan

[73] Assignee: Matsushita Electric Industrial Co., Ltd., Osaka, Japan

[21] Appl. No.: 263,259

[22] Filed: May 13, 1981

[30] Foreign Application Priority Data

May 16, 1980 [JP] Japan ..... 55-68020[U]

[51] Int. Cl.[3] ..... H01C 10/32

[52] U.S. Cl. ..... 338/334; 338/164; 338/184; 338/199

[58] Field of Search ..... 338/128–131, 338/162, 164, 184, 199, 334; 74/565, 504

[56] References Cited

U.S. PATENT DOCUMENTS 2,917,642 12/1959 Jarrett et al. ..... 338/130 X 3,139,769 7/1964 Gauchat ..... 338/334 X

*Primary Examiner*—C. L. Albritton

*Attorney, Agent, or Firm*—Barnes, Kisselle, Raisch, Choate, Whittemore & Hulbert

[57] ABSTRACT

A variable resistor device with a lock mechanism in which a push on the operating rod thereof causes it to be locked in its inserted state and another push causes it to restore to its original position. According to the present invention, even if a plurality of such devices are mounted on one operating panel with the operating rods crowdedly projecting, there is substantially no possibility that the user inadvertently manipulates two or three adjacent rods at a time. Further the push stroke of the operating rod can be optionally set with ease, and even if the push stroke is set large, the overall length of the device can be made small.

8 Claims, 9 Drawing Figures

VARIABLE RESISTOR DEVICE WITH LOCK MECHANISM

Figure 1:
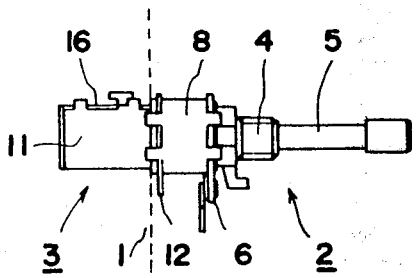

The present invention relates to a variable resistor device with a lock mechanism in which a first push on the knob portion of the operating rod thereof causes the rod to be held in its inserted position and a second push causes the rod to restore to its original position.

Recent miniaturization and sophistication of audio devices such as tuners or amplifiers have rendered the operating panel thereof small with an increased number of operating rods crowdedly projecting. Consequently the narrowed intervals between the operating rods are likely to cause the user to inadvertently manipulate two or three adjacent rods at a time even if he desires to operate one rod.

One way to overcome this problem is to provide the operating rod with a lock mechanism whereby the rod is kept in its retracted (locked) position when not in use and in its projecting (unlocked) position when in use. However conventional lock mechanisms invariably require a considerable length to assure a sufficient push stroke of the rod. Further the conventional mechanism is incapable of optinally setting the push stroke of the rod. Thus the conventional mechanism is against miniaturization and sophistication of audio devices. The term "push stroke" used herein should be understood to mean the distance between the projecting position and retracted position of the rod.

It is therefore the main object of the present invention to provide a variable resistor with a lock mechanism which is capable of optionally setting the push stroke of the operating rod and which can be made small in length even if the push stroke of the rod is set large.

In order to fulfil this object, the present invention provides a variable resistor with a lock mechanism comprising a resistor housing portion, an operating rod mounted rotatably and axially slidably in the housing portion, and a lock mechanism housing portion attached to one end of the resistor housing portion and provided with the lock mechanism for locking the operating rod, the lock mechanism housing portion comprising a box-shaped case, wherein the lock mechanism comprises a lock member axially movable in the case in response to the axial movement of the rod and a ratchet member rotatably provided on the case and having a pawl to be brought into contact with the lock member, the top surface of the lock member being provided close to one side thereof with an engagement projection having a V-shaped cutout remote from said one side for engagement with the pawl, the top surface of the lock member further being provided with a pawl passage arround the engagement projection with its entrance and exit ends facing said one side, the exit end being positioned above the entrance end, whereby the pawl is guided through the pawl passage from the entrance end to the V-shaped cutout and from the cutout to the outlet end to lock and release the operating rod in response to the axial movement thereof.

According to the present invention, even if a plurality of such resistor devices are mounted on one operating panel, the user can readily manipulate a desired operating rod without inadvertently touching and turning adjacent rods. Further the resistor device, with the construction described above, can be rendered small in length, thus contributing to miniaturization of audio devices.

Figure 2:
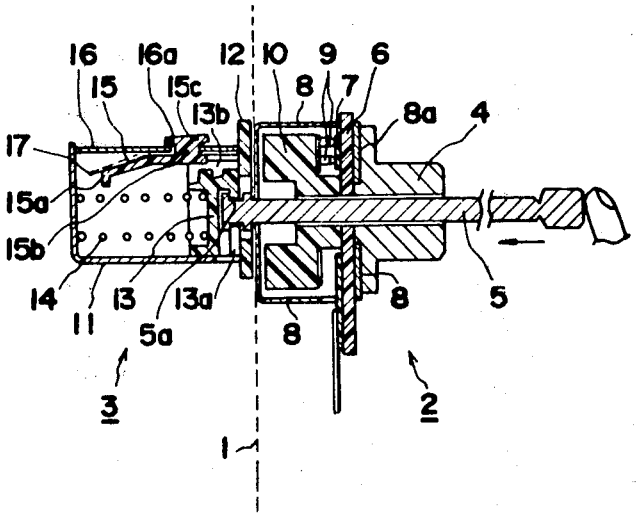
Figure 3:
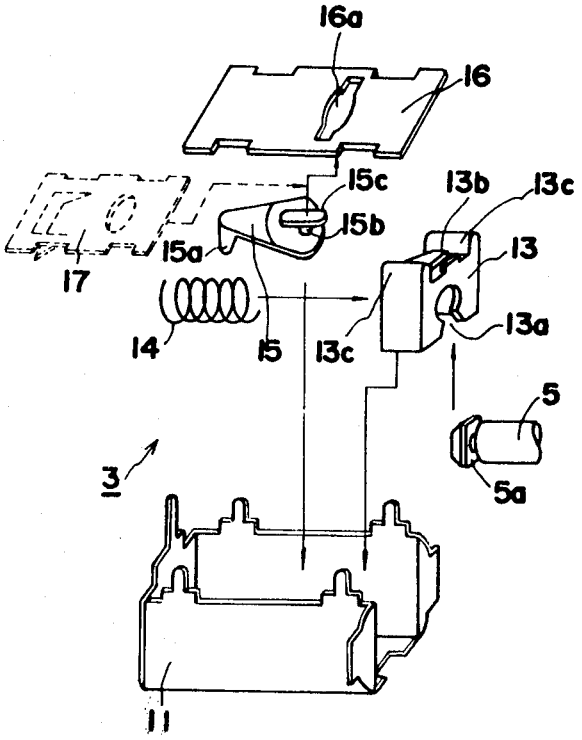
Figure 4:
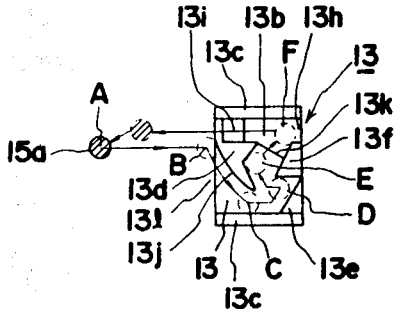
Figure 5A:
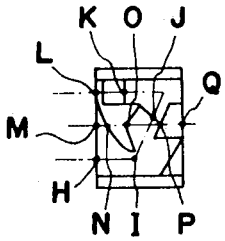
Figure 5B:
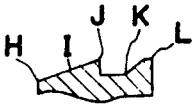
Figure 5C:
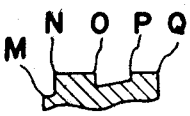
Figure 6A:
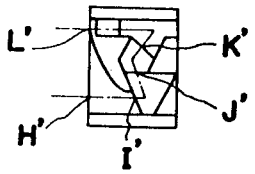
Figure 6B:
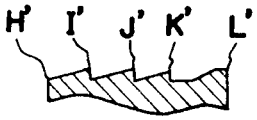

These and other features and effects of the present invention will be readily understood from the description of embodiments given with reference to the accompanying drawings, in which;

FIG. 1 is a side view of a variable device with a lock mechanism embodying the invention, FIG. 2 is a view in longitudinal section of the same, FIG. 3 is an exploded perspective view showing the lock mechanism housing portion of the same, FIG. 4 is a top view of a lock member accommodated in the housing portion, FIG. 5*a* is the same view of FIG. 4, FIG. 5*b* and FIG. 5*c* are sectional views taken on the lines H-I-J-K-L and M-N-O-P-Q in FIG. 5*a* respectively, FIG. 6*a* is a view similar to FIG. 4 showing another lock member embodying the invention, and FIG. 6*b* is a sectional view taken on the line H'-I'-J'-K'-L' in FIG. 6*a*.

Referring to FIGS. 1 and 2, a resistor housing portion 2 of ordinary construction is shown to the right of a broken line 1 while a lock mechanism housing portion 3 is shown to the left. An operating rod 5 is rotatably and axially slidably supported in a bearing 4. A resistor body 7 is provided on a mounting plate 6 which in turn is attached to the bearing 4 by means of the engaging portion 8*a* of a case 8. A brush holder 10 carrying a brush 9 in sliding contact with the resistor body 7 is provided centrally with a through-hole in which the rod 5 axially slidably fits. The holder 10 is integrally rotatable with the rod 5.

Next the construction of the lock mechanism housing portion 3 is described with particular reference to FIG. 3. A box-shaped case 11 is fixed to the case 8 via an insulator plate 12, and a lock member 13 is slidably provided in the case 11. A groove 5*a* is formed in the rear end portion of the rod 5, and a cutout 13*a* is formed in the lower portion of the lock member 13. By bringing the grooved portion into engagement with the cutout portion the rod 5 is rotatably connected to the lock member 13. A push on the rod 5 causes the lock member 13 to slide in the case 11 against the urging force of a spring 14. The lock member 13 has its top surface 13*b* formed with special projections and indentations as hereinafter described in detail.

A ratchet member 15 is provided above the lock member 13. More specifically, the ratchet member 15 has a T-shaped projection provided by a shaft portion 15*b* and an engaging portion 15*c*, and the member 15 is held in place on a cover plate 16 provided at the top of the case 11 by inserting the T-shaped projection through a hole 16*a* formed in the plate 16 and thereafter turning the member 15 relative to the plate 16 to achieve engagement. If the lock member 13 comes immediately under the ratchet member 15, a pawl 15*a* at the front end of the member 15 presses against the top surface 13*b* of the lock member 13 and comes into engagement with one of the projections of the surface 13*b* to lock the rod 5 which thereafter can be unlocked by breaking said engagement. In order to enhance the pressing force of the ratchet member, a leaf spring 17 indicated by a phanton line may be interposed between the member 15 and the cover plate 16.

The concrete configuration of the top surface 13*b* of the lock member is now described with reference to FIGS. 4, 5*a*, 5*b* and 5*c*.

In FIG. 4, indicated at 13*c* are side wall projections which are the highest; and at 13*d*, 13*e* and 13*f* are an engagement projection having a V-shaped cutout, a triangular projection and a trapezoid projection respectively, the three projections being the second highest. A primary surface 13g which is greatly inclined is formed one step lower than the projections 13d–13f and a secondary surface 13h is made one step lower than the primary surface 13g. A tertiary surface 13i is inclined to connect the secondary surface 13h to the top surface of the engagement projection 13d at one side of the lock member 13. A pawl passage is provided by the primary, secondary, and tertiary surfaces. A guide wall 13l provided by a lateral surface of the engagement projection 13d serves to introduce the pawl 15a of the ratchet member 15 into the passage through the entrance end 13l of the passage. A cliff 13k is formed at the boundary between the primary surface 13g and the secondary surface 13h to prevent reverse movement of the pawl 15a. The exit end of the pawl passage is located at the end of the tertiary surface 13i close to said one side of the lock member 13. It should be borne in mind here that all of the lateral surfaces of the projections 13c–13f serve to guide the pawl 15a along the pawl passage.

Further reference to the construction of the top surface 13b will be made using FIGS. 5a, 5b and 5c.

In FIG. 5b showing a sectional view along the line H-I-J-K-L in FIG. 5a, a mild inclination is formed between H and J, and a cliff (the cliff 13k) is formed at J. After a flat surface between J and K comes a rather steep inclination between K and L.

In FIG. 5c showing a sectional view along the line M-N-O-P-Q in FIG. 5a, there are gentle inclinations between M and N, and between O and P. A cliff corresponding to the guide wall 13j is seen at N.

The operation of the variable resistor device having the above construction will next be described.

As seen in FIG. 2, a leftward push on the knob portion of the operating rod 5 causes the lock member 13 to move leftward against the counter force of the spring 14. As a result, the top surface 13b of the lock member 13 comes in contact with the pawl 15a of the ratchet member 15.

Viewed from a different perspective, this means that the pawl 15a has transferred from a position A located away from the lock member 13 to a position B at the entrance end 13l of the pawl passage (see FIG. 4). Upon further push on the rod 5 to shift the lock member 13 leftward the pawl 15a goes upward on the primary surface 13g as guided along the guide wall 13j and soon comes up against the side wall projection 13c (position C) which in turn guides the pawl into the valley between the triangular projection 13e and trapezoid projection 13f (position D). At this point the sliding movement of the operating rod 5 is ceased, and if the rod 5 is liberated, the pawl is trapped in the V-shaped cutout of the engagement projection 13d (position E) due to the restoring movement of the lock member 13 imparted by the biasing force of the spring 14. The rod 5 is thus locked as withdrawn into the resistor device, giving the impression that it has become shortened. It is worthy of note that even in this state the resistance of the resistor device can be varied by turning the rod.

In order to unlock the operating rod 5, another slight push thereon is only what is required. Stated specifically, the slight push causes the pawl 15a to fall from the primary surface 13g (position E) to the secondary surface 13h (position F), and if the rod is freed of any restriction in this state, the pawl returns to its initial position (position A) past the tertiary surface 13i; that is, the lock member 13 restores to its original position by the action of the spring 14.

The ratchet member 15 in this embodiment is made of an elastic material, and for this reason it will not be damaged even if an abnormal tension force is exerted on the operating rod 5 because such a force causes it to warp to ultimately liberate the rod.

The operating rod 5 can be locked and unlocked in this manner repetitively by repetition of a push on the rod. However the pawl 15a, when away from the lock member 13, may assume any position. In order to avoid erroneous operation it is therefore essential to guide the pawl through the entrance end 13l into the pawl passage while preventing its entry through the exit end. The presence of the guide wall 13j and the position of the exit end above the entrance end effectively serve this purpose.

In this embodiment since the primary surface 13g and tertiary surface 13i serving as part of the pawl passage are provided in the form of inclined surfaces, they give a smooth feel when pushing the rod to lock or unlock it. Further the cliff 13k prevents an erroneous operation due to the reverse movement of the pawl 15a.

FIGS. 6a and 6b show another lock member embodying the invention. In FIG. 6b illustrating a sectional view along the line H'-I'-J'-K'-L' in FIG. 6a, it is seen that cliffs are provided at I', J', and K'. According to this embodiment, the reverse movement of the pawl is prevented still more effectively.

In both embodiments described above, the lock member along with the pawl is brought into contact with the ratchet member only when it is locked, as opposed to conventional lock mechanisms in which a long lock member is always kept in contact with a ratchet member. Therefore the lock member of the present invention can be made small in length, consequently reducing the overall length of the resistor device. Further the push stroke of the operating rod can be altered by changing the position at which the ratchet member is mounted.

What is claimed is:

1. A variable resistor device with a lock mechanism comprising a resistor housing portion, an operating rod mounted rotably and axially slidably in the housing portion, and a lock mechanism housing portion attached to one end of the resistor housing portion and provided with the lock mechanism for locking the operating rod, the lock mechanism housing portion comprising a box-shaped case, wherein:

the lock mechanism comprises a lock member axially movable in the case in response to the axial movement of the operating rod and a ratchet member rotatably provided on the case and having a pawl to be brought into contact with the lock member, the top surface of the lock member being provided close to one side thereof with an engagement projection having a V-shaped cutout remote from said one side for engagement with the pawl, the top surface of the lock member further being provided with a pawl passage around the engagement projection with its entrance end and exit end facing said one side, the exit end being positioned above the entrance end, whereby the pawl is guided through the pawl passage from the entrance end to the V-shaped cutout and from the cutout to the exit end to lock and release the operating rod in response to the axial movement thereof.

2. A device as defined in claim 1 wherein the lateral surface of the engagement projection facing the entrance end provides a guide wall for smoothly guiding the pawl into the pawl passage through the entrance end.

3. A device as defined in claim 1 wherein the pawl passage is provided by the top surface of the lock member, that part of the surface of the pawl passage extending from the entrance end to a point just past the V-shaped cutout is gently upwardly inclined, and a cliff is formed at the end of the gently inclined surface for preventing the reverse movement of the pawl.

4. A device as defined in claim 3 wherein the cliff is followed by a substantially flat surface which is further followed by another inclined surface extending upwardly to the exit end of the pawl passage.

5. A device as claimed in claim 1 wherein projection means is provided close to the side of the lock member opposite to said one side and in staggered relation to the V-shaped cutout for temporarily holding and guiding the pawl into the V-shaped cutout.

6. A device as defined in claim 5 wherein side wall projections are provided close to the remaining sides of the lock member for guiding the pawl, in co-action with the engagement projection and the projection means, to move along the pawl passage.

7. A device as defined in claim 1 wherein the ratchet member is made of elastic material.

8. A device as defined in claim 1 wherein a leaf spring is attached to the ratchet member for enhancing the pressing force of the ratchet member.

* * * * *